US009267274B2

(12) United States Patent
Ball et al.

(10) Patent No.: US 9,267,274 B2
(45) **Date of Patent: *Feb. 23, 2016**

(54) DEVICE FOR CONCEALING A PLATE ASSOCIATED WITH OVERFLOW PLUMBING

(71) Applicant: WCM Industries, Inc., Colorado Springs, CO (US)

(72) Inventors: William T. Ball, Colorado Springs, CO (US); Eric Pilarczyk, Colorado Springs, CO (US)

(73) Assignee: WCM Industries, Inc., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/701,091

(22) Filed: Apr. 30, 2015

(65) Prior Publication Data

US 2015/0233103 A1 Aug. 20, 2015

Related U.S. Application Data

(63) Continuation of application No. 13/456,017, filed on Apr. 25, 2012, now Pat. No. 9,045,886, which is a continuation-in-part of application No. 12/896,137, filed on Oct. 1, 2010, now Pat. No. 8,769,736.

(60) Provisional application No. 61/479,063, filed on Apr. 26, 2011.

(51) Int. Cl.
*E03C 1/24* (2006.01)
*E03C 1/244* (2006.01)

(52) U.S. Cl.
CPC ..... *E03C 1/244* (2013.01)

(58) Field of Classification Search
CPC ..... E03C 1/24
USPC ..... 4/679–694
See application file for complete search history.

(56) References Cited

U.S. PATENT DOCUMENTS

| | | | |
|---|---|---|---|
| 1,371,715 | A | 3/1921 | West |
| 1,712,704 | A | 5/1929 | Kiser |
| 1,923,482 | A | 8/1933 | Frankenstein |
| 2,096,651 | A | 10/1937 | Romeo |
| 2,150,483 | A | 3/1939 | Bentz |
| 2,193,527 | A | 3/1940 | Bentz |
| 2,664,142 | A | 12/1953 | Scheuerman et al. |
| 2,670,029 | A | 2/1954 | Rossi |
| 2,965,153 | A | 12/1960 | Purcell, Sr. |
| 3,082,432 | A | 3/1963 | Pearlman |
| 3,121,879 | A | 2/1964 | Young |

(Continued)

FOREIGN PATENT DOCUMENTS

GB 2338184 12/1999

OTHER PUBLICATIONS

U.S. Appl. No. 09/593,724, filed Jun. 13, 2000, Ball.

(Continued)

*Primary Examiner* — Lori Baker
(74) *Attorney, Agent, or Firm* — Sheridan Ross P.C.

(57) ABSTRACT

An overflow plate concealing device for bathtubs that is associated with a plate of an overflow system of the bathtub. This aspect of the invention allows the overflow plate to be concealed to allow the user to alter the aesthetic appearance of their bathtub or repair the same.

18 Claims, 16 Drawing Sheets

(56) References Cited

U.S. PATENT DOCUMENTS

| | | | |
|---|---|---|---|
| 3,528,112 | A | 9/1970 | Warnick |
| 4,087,127 | A | 5/1978 | Lotta |
| 4,127,904 | A | 12/1978 | Junker |
| 4,475,256 | A | 10/1984 | Hatala |
| 4,520,515 | A | 6/1985 | Hatala |
| 4,574,409 | A | 3/1986 | McAffrey |
| 4,945,579 | A | 8/1990 | Husting |
| 5,123,123 | A | 6/1992 | Hart et al. |
| 5,745,931 | A | 5/1998 | Ball |
| 5,758,368 | A | 6/1998 | Ball |
| 5,890,241 | A | 4/1999 | Ball |
| 6,066,119 | A | 5/2000 | Ball |
| 6,105,183 | A | 8/2000 | Bly |
| 6,138,298 | A | 10/2000 | Ball |
| 6,148,454 | A | 11/2000 | Ball |
| 6,154,898 | A | 12/2000 | Ball |
| 6,158,809 | A | 12/2000 | Gobbers et al. |
| 6,173,459 | B1 | 1/2001 | Ball |
| 6,192,531 | B1 | 2/2001 | Fritz et al. |
| 6,216,288 | B1 | 4/2001 | Bernau |
| 6,226,806 | B1 | 5/2001 | Ball |
| 6,272,699 | B1 | 8/2001 | Peterson |
| 6,295,664 | B2 | 10/2001 | Fritz et al. |
| 6,317,906 | B1 | 11/2001 | Ball |
| 6,418,570 | B1 | 7/2002 | Ball |
| 6,546,573 | B1 | 4/2003 | Ball |
| 6,631,623 | B1 | 10/2003 | Ball |
| 6,637,050 | B1 | 10/2003 | Ball |
| 6,640,358 | B2 | 11/2003 | Ball |
| 6,675,406 | B2 | 1/2004 | Ball |
| 6,675,407 | B1 | 1/2004 | Ball |
| 6,681,420 | B1 | 1/2004 | Ball |
| 6,687,926 | B1 | 2/2004 | Bayley |
| 6,691,411 | B2 | 2/2004 | Ball |
| 6,823,540 | B2 | 11/2004 | Gunn |
| 6,836,911 | B2 | 1/2005 | Minnick |
| 7,096,522 | B2 | 8/2006 | Hirtriter |
| 7,127,752 | B2 | 10/2006 | Ball |
| 7,328,953 | B2 | 2/2008 | Werschmidt |
| 7,451,502 | B2 | 11/2008 | Ball |
| 7,503,083 | B2 | 3/2009 | Ball |
| 7,506,385 | B2 | 3/2009 | Werschmidt |
| 7,549,702 | B2 | 6/2009 | Meyers |
| 7,774,871 | B1 | 8/2010 | Arsenault |
| 7,856,677 | B1 | 12/2010 | Harris |
| 8,166,584 | B2 | 5/2012 | Ball |
| 8,266,735 | B2 | 9/2012 | McLeod |
| 8,302,220 | B2 | 11/2012 | Ball |
| 8,769,736 | B2 | 7/2014 | Ball |
| 9,045,886 | B2 * | 6/2015 | Ball ..... E03C 1/244 |
| 2003/0192115 | A1 | 10/2003 | Oropallo et al. |
| 2004/0068793 | A1 | 4/2004 | Ball |
| 2004/0103474 | A1 | 6/2004 | Ball |
| 2004/0111797 | A1 | 6/2004 | Ball |
| 2007/0039098 | A1 | 2/2007 | Ball |
| 2007/0130689 | A1 | 6/2007 | Condon et al. |
| 2008/0047060 | A1 | 2/2008 | Ball |
| 2008/0196161 | A1 | 8/2008 | Ball |
| 2010/0037392 | A1 | 2/2010 | Ball |

OTHER PUBLICATIONS

Extended European Search Report for European Patent Application No. 12002970.7 dated Mar. 25, 2014, 9 pages.

Official Action for U.S. Appl. No. 12/896,137 mailed Sep. 5, 2013, 9 pages.

Official Action for U.S. Appl. No. 12/896,137 mailed Feb. 24, 2014, 6 pages.

Notice of Allowance for U.S. Appl. No. 12/896,137 mailed May 15, 2014, 5 pages.

* cited by examiner

DEVICE FOR CONCEALING A PLATE ASSOCIATED WITH OVERFLOW PLUMBING

This application is a continuation of U.S. patent application Ser. No. 13/456,017, filed Apr. 25, 2012, which is a continuation-in-part of U.S. patent application Ser. No. 12/896,137, filed Oct. 1, 2010, which claims the benefit of U.S. Provisional Patent Application Ser. No. 61/479,063, filed Apr. 26, 2011, the entire disclosures of which are incorporated by reference herein.

This application is also related to various applications and patents related to overflow systems associated with bathtubs or other basins, such as U.S. patent application Ser. No. 09/593,724, filed Jun. 13, 2000, U.S. Patent Application Publication Nos. 2004/0068793, filed Sep. 30, 2003, 2004/0117907, filed Dec. 10, 2003, 2004/0111797, filed Dec. 17, 2003, 2008/0235866, filed Mar. 28, 2008 and 2004/0103474 filed Nov. 25, 2003. In addition, this application is related to U.S. Pat. No. 6,691,411, filed Sep. 17, 2001, U.S. Pat. No. 6,675,406, filed Aug. 28, 2002, U.S. Pat. No. 6,637,050, filed Aug. 16, 2002, U.S. Pat. No. 7,127,752, filed Dec. 17, 2003 and U.S. Pat. No. 5,890,241, filed Feb. 4, 1998. The entire disclosures of which are incorporated by reference herein.

FIELD OF THE INVENTION

Embodiments of the present invention generally relate to devices for concealing a portion of a bathtub's overflow plumbing. One embodiment of the present invention, employs a cover that conceals an existing overflow plate, which allows selective alterations or repairs to the overflow plumbing.

BACKGROUND OF THE INVENTION

Overflow plumbing is commonly associated with basins for holding fluids. Overflow systems provide an access point for drain clean out and may help address substantial overfilling of the basin. Bathtubs, for example, employ overflow assemblies comprised of an overflow pipe that is associated with an outlet port of the bathtub and that is interconnected to a sidewall of the bathtub. An overflow plate conceals the outlet port. The overflow plate includes at least one fluid flow opening that allows water to flow from the bathtub to the overflow pipe if the need arises.

Often, it is desirous to change the look and feel of a bathroom. One way to accomplish this is to change plumbing fixtures associated with the bathtub, sink, etc. For example, one may want to replace an existing faucet and related plumbing components from a nickel-plated finish to a chrome plated finish, or vice versa. This task may seem simple, but it is often laborious and may require that all or portions of the plumbing system associated with the bathtub, sink, etc. be re-tested. For example, attention is directed to U.S. Pat. No. 5,890,241 to Ball ("Ball I"), which is incorporated by reference in its entirety herein. Ball I provides an overflow plumbing system having an overflow pipe that is associated with a bathtub having a cover plate interconnected to the overflow pipe by way of at least one fastener. The fasteners cooperate with bosses associated with the overflow pipe to hold the cover in place. The overflow system of Ball I is primarily aligned with the outer portion surface of the bathtub and requires an interconnected sleeve to engage an inner surface of the bathtub to secure the overflow pipe to the bathtub. One of skill in the art will appreciate that the aligning of the sleeve and the overflow pipe is difficult as the overflow pipe is located behind the bathtub wall and is, thus, out of view and difficult to access.

Furthermore, interconnection of the screw to the bosses of the overflow pipe is difficult. These factors make replacing overflow plates commonly found in many bathrooms difficult, time consuming, and expensive.

This difficulty of replacing existing cover plates has been addressed by leaving it in place and concealing the same with a supplemental cover. For example, attention is directed to U.S. Pat. No. 6,138,298 to Ball ("Ball II"), which is incorporated by reference in its entirety herein. Ball II discloses a cover having a clip integrated on an interior surface thereof. To install, the clip is at least partially slid into a fluid opening associated with the existing overflow plate. The clip holds the replacement cover in place and conceals the existing plate while maintaining an opening that allows fluid to flow from the bathtub to the overflow pipe. One drawback with Ball II is that the clip may fail or the replacement cover may loosen over time, thereby allowing the cover to slip relative to the overflow plate which could mar the inner surface of the bathtub. Furthermore, the clip obstructs the fluid opening provided by the existing overflow plate, which may decrease fluid flow rate into the overflow pipe. Finally, the device of Ball II may not fit accommodate many overflow plates.

Thus, it is a long felt need to provide a device for concealing an existing overflow plate that is easy to install, does not interfere with the flow characteristics of the overflow system, and is universal in nature, i.e., concealing overflow plates of various shapes, sizes, and styles.

SUMMARY OF THE INVENTION

It is one aspect of the present invention to provide a device for concealing a cover plate of an overflow system. More specifically, overflow systems of some bathtubs are comprised of an overflow pipe having a plate for association with an outer surface of a bathtub. A sleeve is interconnected to the overflow pipe wherein an inner surface of the sleeve and the plate firmly engage the bathtub to secure the overflow pipe. That is, the bathtub wall is positioned between the inner surface of the sleeve and the plate, thereby securing the overflow pipe to the bathtub. To conceal the opening associated with the overflow pipe, an overflow plate is included that is interconnected to the sleeve and/or overflow pipe by way of at least one screw or other fastening mechanism. Embodiments of the present invention can be used in conjunction with many overflow systems. The overflow plate includes at least one opening that allows a fluid from inside the bathtub to enter into the sleeve and overflow pipe when the liquid level in the bathtub reaches a predetermined level. One embodiment of the present invention is an overflow plate cover having an outer surface with a wall extending therefrom. The wall includes an aperture that aligns with the fluid opening of the overflow plate to maintain a fluid passage from inside the bathtub to the overflow pipe. The contemplated cover is associated with the overflow plate by way of a retention plate, which will be described in further detail below. In operation, fasteners, which interconnect the overflow plate to the overflow pipe, are loosened to allow the overflow plate to be separated from the bathtub wall. Next, the retention plate is positioned between the overflow plate and the bathtub wall. The fasteners are tightened to affix the retention plate between the overflow plate and the bathtub wall.

One embodiment of the present invention includes a retention plate with a lip that selectively receives at least one protrusion associated with the wall of the overflow plate cover to secure the overflow plate cover. The overflow plate cover is able to rotate, i.e., about a normal axis thereof, relative to the retention plate. To ensure the fluid passage is unobstructed, an aperture or cut out in the overflow plate cover wall is rotated and positioned generally in line with the fluid opening of the overflow plate.

In an alternative embodiment of the present invention, the overflow plate cover is glued or otherwise bonded to the bathtub wall. The overflow plate cover of this embodiment of the present invention would also include an outer surface and an inner surface with a wall depending therefrom. The inner surface is spaced from an outer surface of the overflow plate. In one embodiment, the wall also includes an outwardly or inwardly extending lip to receive the bonding material and is associated with the bathtub wall.

It is another aspect of the present invention to provide an overflow plate cover that will conceal overflow plates of various styles, sizes, and shapes. Those of skill in the art appreciate that overflow plates are not standard. One embodiment of the present invention is thus of such size and shape to accommodate most, if not all, of the overflow plates on the market.

It is another aspect that the present invention provide an overflow plate cover that accommodates overflow plates of various designs. More specifically, when installed, overflow plates used in some parts of the world, such as Europe, are spaced from the inner surface and extend into the bathtub. These overflow plates include a sidewall with an interconnected flange that abuts the inner surface of the bathtub, a plurality of holes that allows water to enter the overflow pipe, and an anchor for securing a drain stopper chain. As these types of overflow plates are very difficult to remove, one embodiment of the present invention provides an adapter that interfaces with the overflow port flange. The adapter also includes an outer edge that selectively receives the internal surface of the overflow plate cover similar to the embodiment described above.

It is yet another aspect of the present invention to provide a system for concealing a plate of an overflow system, the overflow system comprised of an overflow plate spaced from a flange by way of a sidewall, the flange being engaged on an inner surface of a fluid basin, the overflow plate having a fluid opening that allows fluid to pass from the basin, comprising: an adapter which has an outer edge and an inner edge adapted to be engaged on the flange of the overflow system wherein the sidewall of the overflow system is positioned within the inner edge of the adapter; and an overflow plate cover for selective interconnection to the adapter, the overflow plate cover having an outer surface with a wall extending therefrom wherein the wall selectively engages the outer edge of the adapter, the overflow plate cover also having an opening that provides a continuous fluid flow path from inside the basin to the overflow system.

It is still yet another aspect of the present invention to provide a device that receives a cover for concealing a plate of an overflow system, the overflow system comprised of the overflow plate spaced from a flange by way of a sidewall, the flange being engaged on an inner surface of a fluid basin, the overflow plate having a fluid opening that allows fluid to pass from the basin, comprising: an outer edge and an inner edge that is adapted to receive the sidewall of the overflow system.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
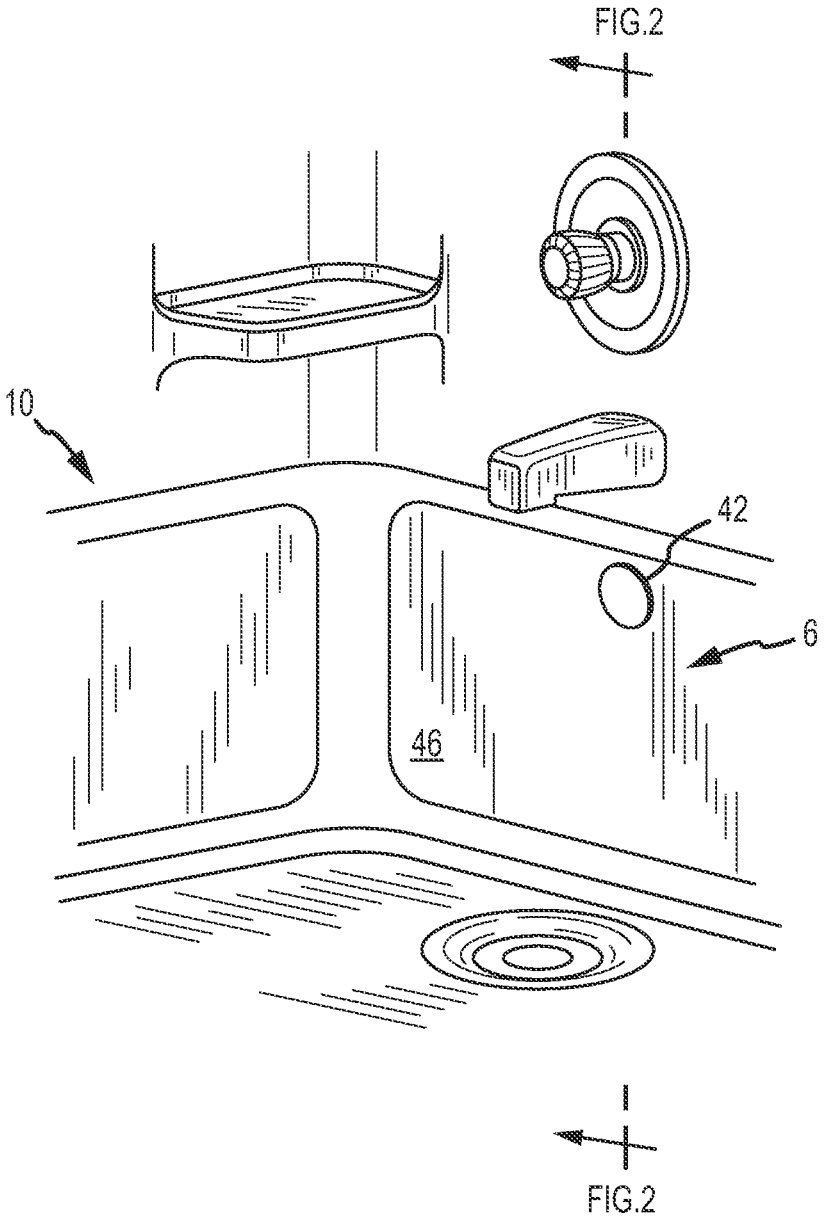
FIG. 1 is a partial perspective view of a typical bathtub.

To assist in the understanding of the present invention the following list of components and associated numbering found in the drawings is provided herein:

| # | Component |
|---|---|
| 2 | Overflow pipe |
| 6 | Sidewall |
| 10 | Bathtub |
| 14 | Plate |
| 22 | Sleeve |
| 26 | Inner surface |
| 30 | Inner surface |
| 34 | Screw |
| 38 | Outlet port |
| 42 | Overflow plate |
| 46 | Outer surface |
| 50 | Opening |
| 54 | Overflow plate cover |
| 58 | Outer surface |
| 62 | Wall |
| 66 | Opening |
| 70 | Retention plate |
| 74 | Lip |
| 154 | Overflow plate cover |
| 162 | Wall |
| 166 | Opening |
| 170 | Lip |
| 174 | Inner surface |
| 178 | Upper retention plate |
| 182 | Lower retention plate |
| 186 | Lug |
| 190 | Tab |
| 200 | Overflow plate cover |
| 204 | Overflow plate |
| 208 | Flange |
| 212 | Sidewall |
| 216 | Holes |
| 220 | Anchor |
| 224 | Adapter |
| 228 | Outer edge |
| 232 | Adhesive strip |
| 236 | Sidewall |
| 240 | Opening |
| 244 | Plate |
| 248 | Front surface |
| 252 | Connector |
| 256 | Hole |
| 260 | Retaining member |
| 264 | Hole |
| 268 | End |
| 272 | Finger |
| 276 | Sidewall |
| 280 | Spring |
| 284 | Ledge |
| 288 | Adhesive |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 2:
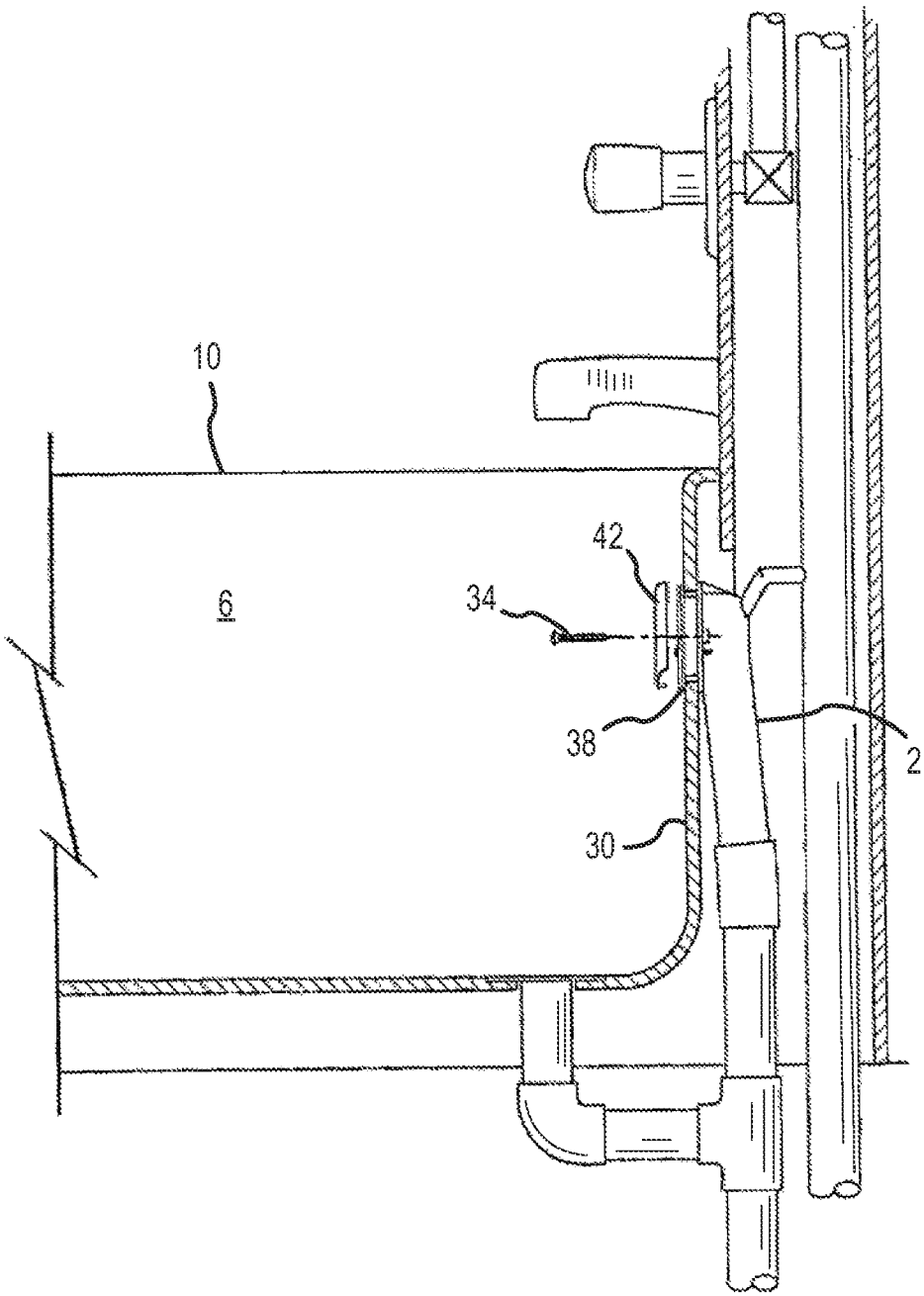
FIG. 2 is a partial sectional view of FIG. 1 showing an overflow system.
Figure 3:
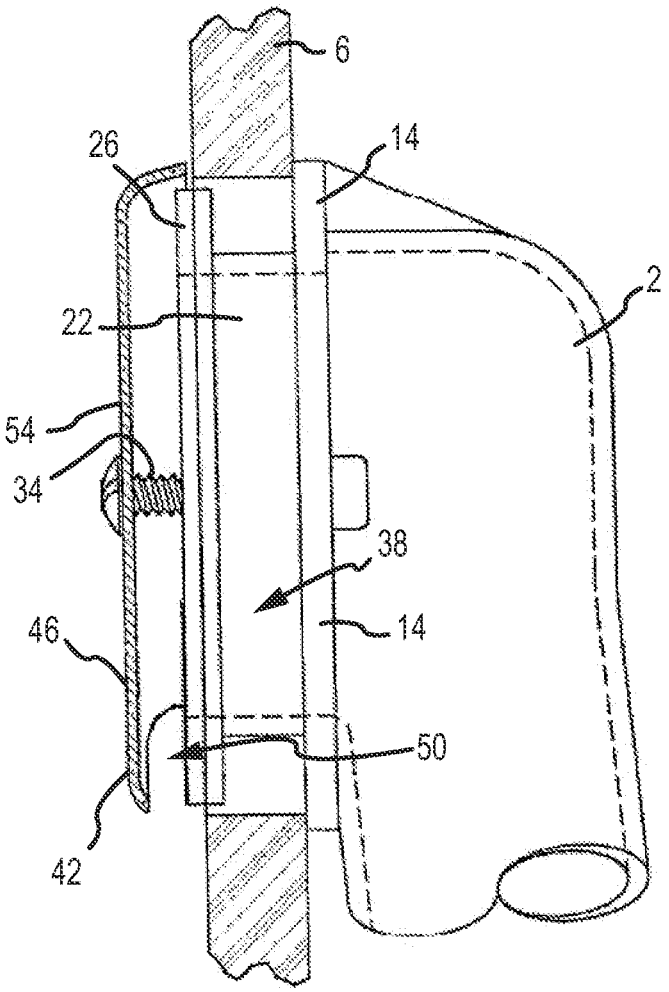
FIG.3 (PRIOR ART)
FIG. 3 is a detailed view of FIG. 2.

Referring now to FIGS. 1-3, an overflow system of the prior art is shown that employs an overflow pipe 2 is associated with a sidewall 6 of a bathtub 10. The overflow pipe 2 includes a plate 14 that is abutted against an outer surface of the bathtub 10. A sleeve 22 having an inner surface 26 is abutted against an inner surface 30 of the bathtub wall 6 to secure the overflow pipe 2 to the bathtub 10. The sleeve 22 is associated with the overflow pipe 2 by a threaded interconnection, a friction fit, or any other common attachment scheme. To conceal an outlet port 38 that accommodates the overflow pipe 2, an overflow plate 42 is employed that utilizes the screw 34 to interconnect to the sleeve 22 and/or overflow pipe 2. The overflow plate 42 includes an outer surface 46 that conceals the outlet port 38 of the bathtub 10 and a fluid opening 50 that allows fluid to flow within the bathtub 10 and into the overflow pipe 2.

Figure 4:
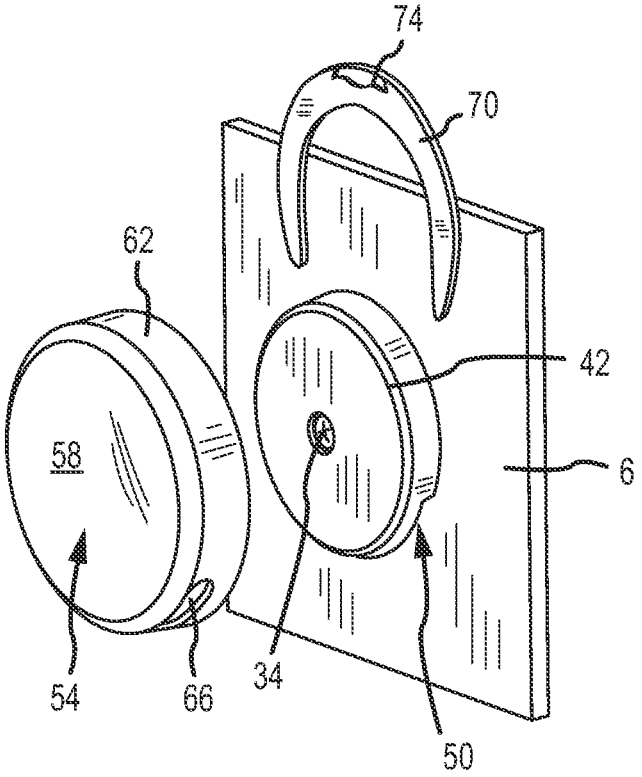
FIG. 4 is a perspective view of one embodiment of the present invention.

Referring now specifically to FIG. 4, an overflow plate cover 54 is employed to conceal the overflow plate 42. One of skill in the art will appreciate that embodiments of the present invention described below are not limited to incorporation onto the overflow system shown in FIG. 1 and can be used in conjunction with many overflow systems. One embodiment of overflow plate cover 54 of the present invention includes an outer surface 58 having a wall 62 depending therefrom. Although shown as cylindrical, one skilled in the art will appreciate that the overflow plate cover 54 may be of any shape and be made of any material or finish. The wall 62 includes at least one opening 66 therethrough that is aligned with a fluid opening 50 of the overflow plate 42. One skilled in the art will appreciate that the opening 66 may also be an enlarged cut out similar to that of the existing overflow plate opening 50 shown, thereby increasing the fluid flow capacity of the overflow plate cover.

In operation, the screw 34 or screws associated with the overflow plate 42 are loosened, but not completely removed, to allow the overflow plate 42 to be separated from the bathtub wall 6 and a retention plate 70 to be inserted between the overflow plate 4 and the bathtub well 6. Of course, the screw 34 may be removed completely, but those skilled in the art will appreciate that doing so would make it difficult to reconnect the overflow plate 42. Once the retention plate 70 is in place, the screw 34 is tightened, thereby securing the retention plate 70 between the overflow plate 42 and the tub wall 6. Next, the overflow plate cover 54 is associated with the retention plate 70 to conceal the overflow plate 42. In one embodiment, the overflow plate cover 54 detachably engages the outer edge of the retention plate 70. The retention plate 70 may include a lip 74, hooks, lugs, or other mechanisms that cooperate with protrusions (now shown) integrated into the inner portion of the wall 62. Such interconnection scheme is similar to that shown in U.S. Patent Application Publication No. 2004/0117907, which is incorporated by reference in its entirety herein. The lip 74 also maintains the retention plate 70 in place so that it will not fall behind the loosen overflow plate 42. One skilled in the art will appreciate that the overflow plate cover 54 may be interconnected to the retention plate 70 in other ways, such as bonding or with other types of interference fit.

Figure 5:
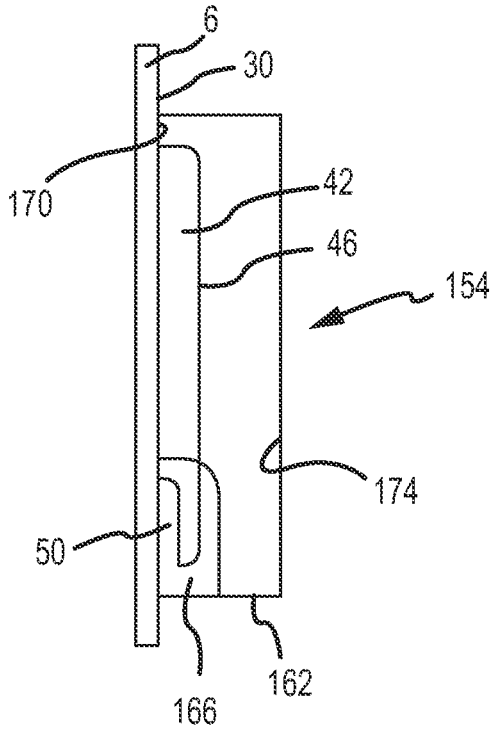
FIG. 5 is an elevation view showing another embodiment of the present invention.

Referring now to FIG. 5, an overflow plate cover 154 of another embodiment of the present invention is shown that includes a wall 162 with a lip 170. The lip 170 receives a sealant or an adhesive and directly bonds to the bathtub wall 6. One drawback of this system compared to the embodiment of FIG. 4 is that the interconnection is permanent or semi-permanent and may mar the inner surface 30 of the bathtub. Alternatively, an inner surface 174 of the overflow plate cover 154 may include inner-extending protrusions that interface with the outer surface 46 of the overflow plate 42. The overflow plate cover includes an opening 166 that communicates with the opening 50 of the overflow plate 42, as does the overflow plate cover.

Figure 6:
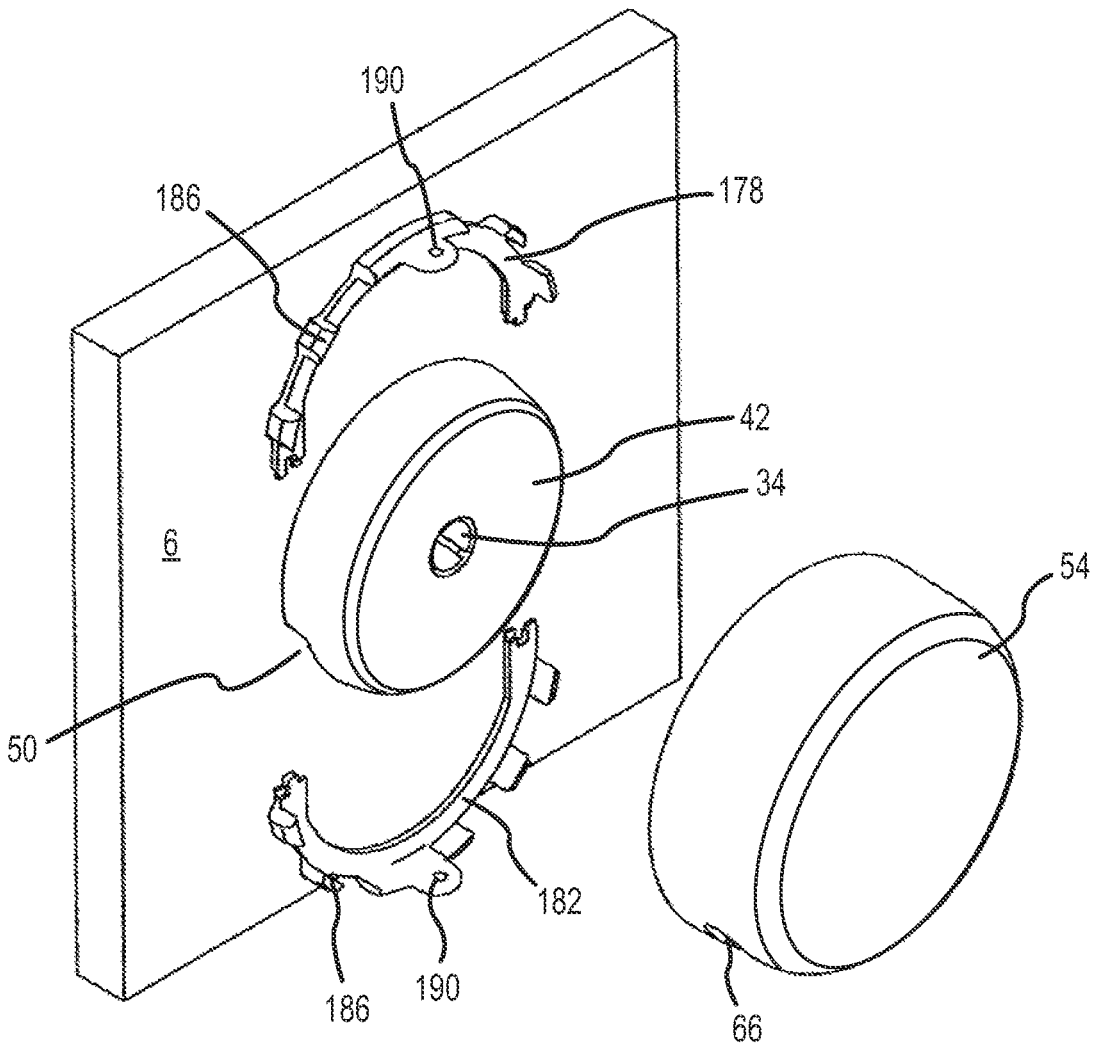
FIG. 6 is an exploded perspective view of another embodiment of the present invention that employs an upper retention plate and a lower retention plate.
Figure 7:
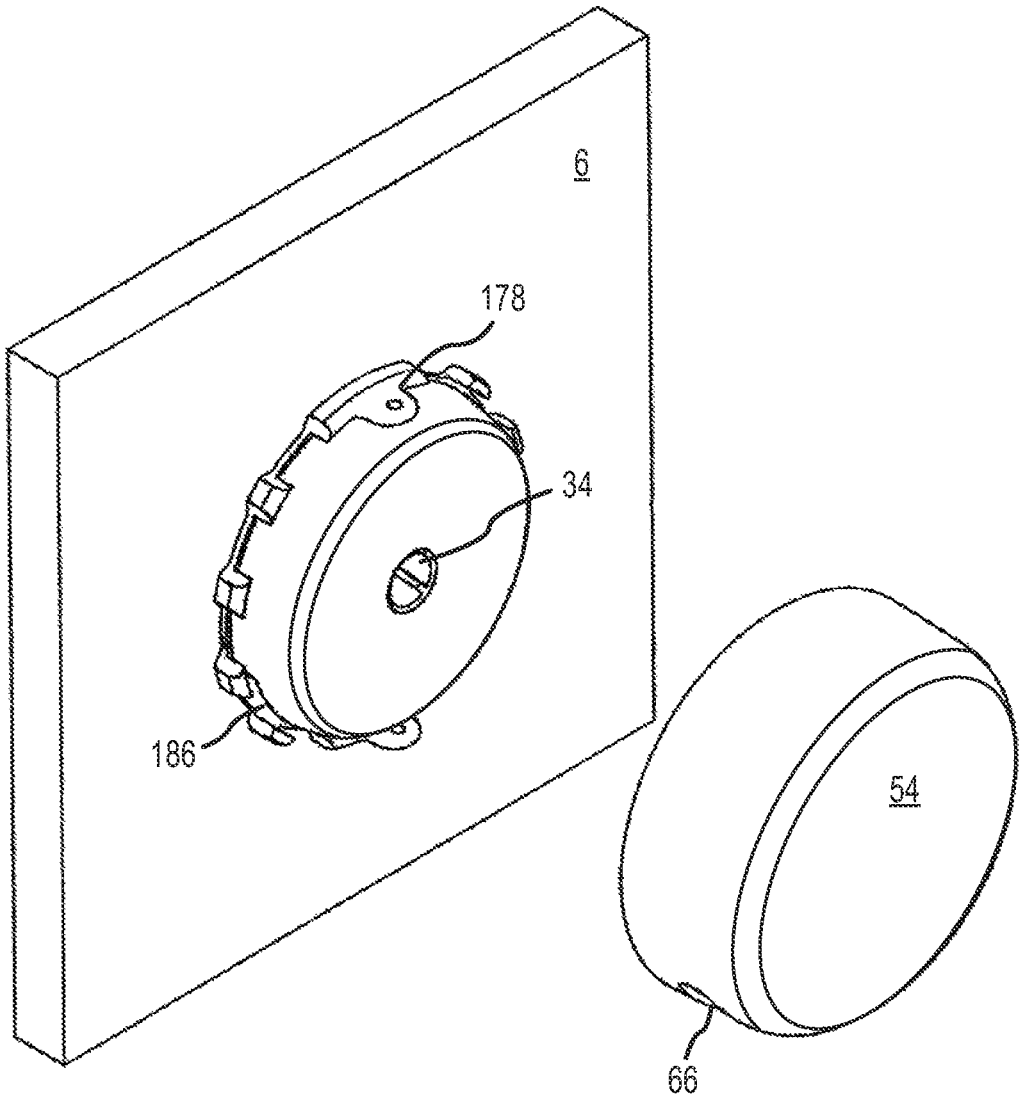
FIG. 7 is a perspective view of FIG. 6 associated with an overflow plate.

Referring now to FIGS. 6 and 7 another embodiment of the present invention is shown that employs an upper retention plate 178 and a lower retention plate 182 that work in conjunction to receive and secure the overflow plate cover 54. The upper retention plate 178 is selectively interconnected to the lower retention plate 182 wherein both the upper retention plate 178 and the lower retention plate 182 employ a series of lugs 186 that interface with an inner surface of the overflow plate cover 54. This interconnection scheme is similar to that disclosed in U.S. Patent Application Publication No. 2004/0117907.

In operation, the overflow plate screw 34 is loosened, thereby allowing the overflow plate 42 to be moved away from the bathtub sidewall 6. The upper retention plate 178 and the lower retention plate 182 are then positioned between the sidewall 6 and the overflow plate 42. The lower retention plate 182 is then interconnected to the upper retention plate 178. To facilitate positioning the upper retention plate 178 and the lower retention plate 182, each plate may include at least one tab 190. One of the tabs 190 may also receive a chain of a chain/stopper drain closure system by way of a hole or a slot. The upper retention plate 178 and the lower retention plate 182 may interconnect in various ways. Here, a key and slot configuration is provided. One of skill in the art will appreciate that although lugs 186 are shown on both the upper retention plate 178 and the lower retention plate 182 only one of those members may contain lugs 186 to secure the overflow plate cover. Once the upper retention plate 178 and the lower retention plate 182 are in place, the screw is re-tightened which firmly secures the upper retention plate 178 and the lower retention plate 182 between the overflow plate 42 and the sidewall 6. Finally, the overflow plate cover 54 is selectively and detachably interconnected to the retention plates such that the opening 66 thereof is aligned with the opening 50 of the overflow plate.

Figure 8:
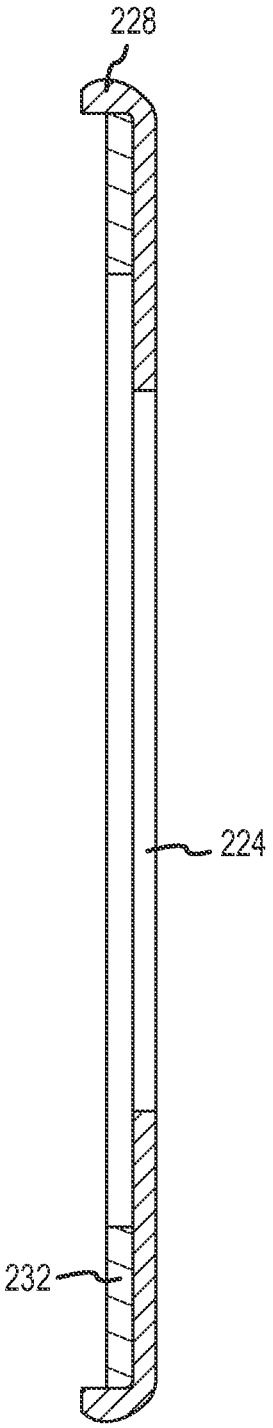
FIG. 8 is a side elevation view of an adapter that interfaces with an overflow plate.
Figure 9:
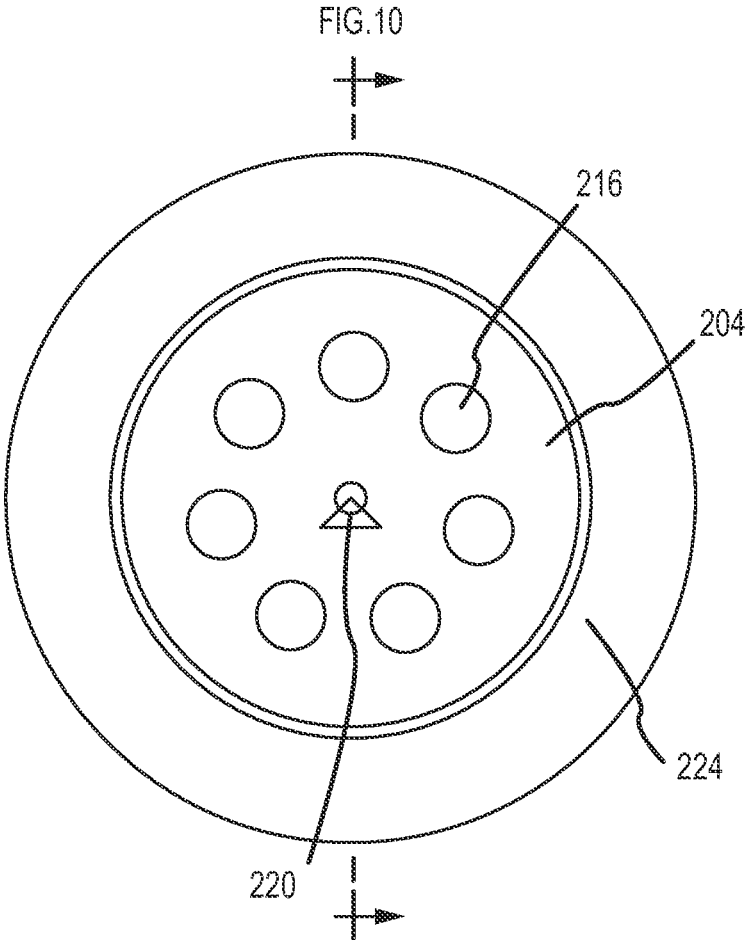
FIG. 9 is a front elevation view of the adapter of FIG. 8 shown interconnected to an overflow plate.
Figure 10:
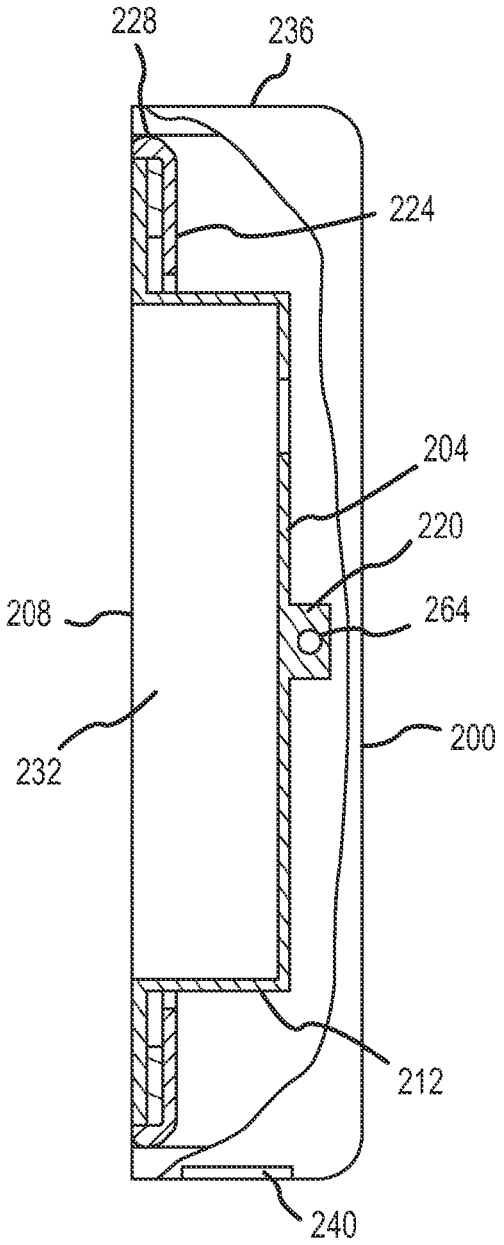
FIG. 10 is a partial side elevation view showing an overflow plate cover associated with the adapter.
Figure 11:
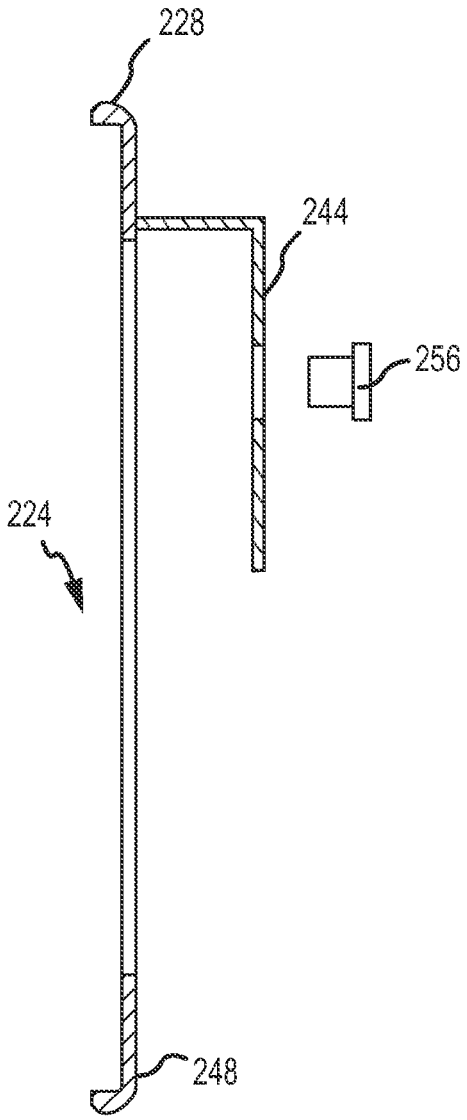
FIG. 11 is a side elevation view of an adapter of another embodiment.

FIGS. 8-10 illustrate another method of associating an overflow plate cover to an overflow plate 204. More specifically, the overflow plates 204 of some designs are spaced from a flange 208 by a sidewall 212. Thus, when incorporated into a bathtub, the overflow plate 204 is separated from the inner surface of the bathtub by the sidewall 212. (See FIG. 10). The overflow plate 204 includes a plurality of holes 216 that allow the ingress of fluid into an overflow pipe (not shown). The overflow plate 204 also includes an anchor 220 that receives a chain that is also associated with a drain stopper. As this type of overflow plate is often difficult to remove without damaging the bathtub or plumbing, it is desirable to conceal the same when it becomes marred, damaged, or the bathroom décor is changed. Unfortunately, because the flange 208 is bonded to the sidewall 6 and not easily separated therefrom, the methods described above may not be suited for this type of overflow plate. Thus embodiments of the present invention contemplate an alternate way of concealing the overflow plate.

For example, FIGS. 8-10 show an adapter 224 that accommodates the sidewall 212 of the overflow plate 204. The adapter 224 also includes an outer edge 228 that receives and secures the overflow plate cover. The adapter 224 also includes an adhesive strip 232 that is removed which allows the adapter 224 to be adhered to the flange 208. Alternatively, an adhesive putty may be used to bond the adapter to the flange. The overflow plate cover 200 is then interconnected to the adapter 224 similar to that shown and described above wherein at least a portion of the outer edge 228 selectively receives the sidewall 236 of the overflow plate cover 200. An opening 240 in the overflow plate cover 200 allows water to reach the holes 216 of the overflow plate 204. The opening 240 may also be made larger to accommodate a drain stopper chain, if necessary. One of skill in the art will appreciate that the outer edge 228 may include a plurality of outwardly-extending lugs, similar to the retention plates shown in FIGS. 6 & 7.

Figures 12, 13:
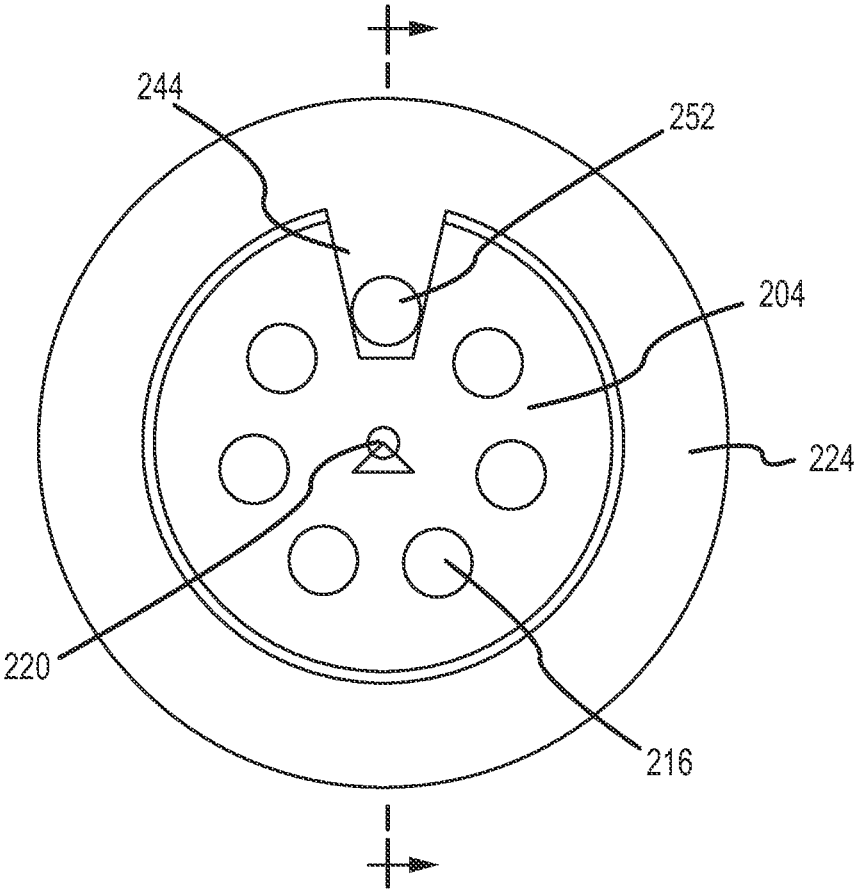
FIG. 12 is a front elevation view of the adapter of FIG. 11 interconnected to an overflow plate.
FIG. 13 is a side elevation view of FIG. 12.
Figure 13:
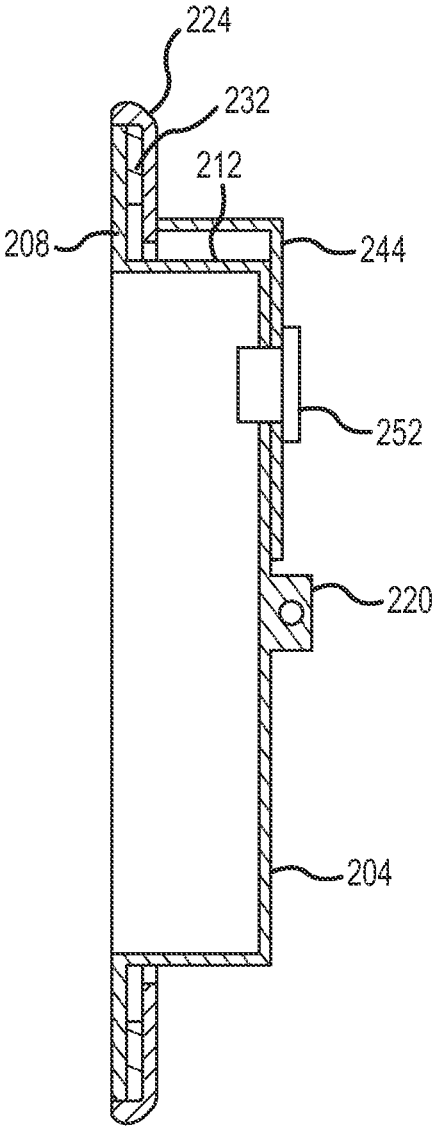
Figure 14:
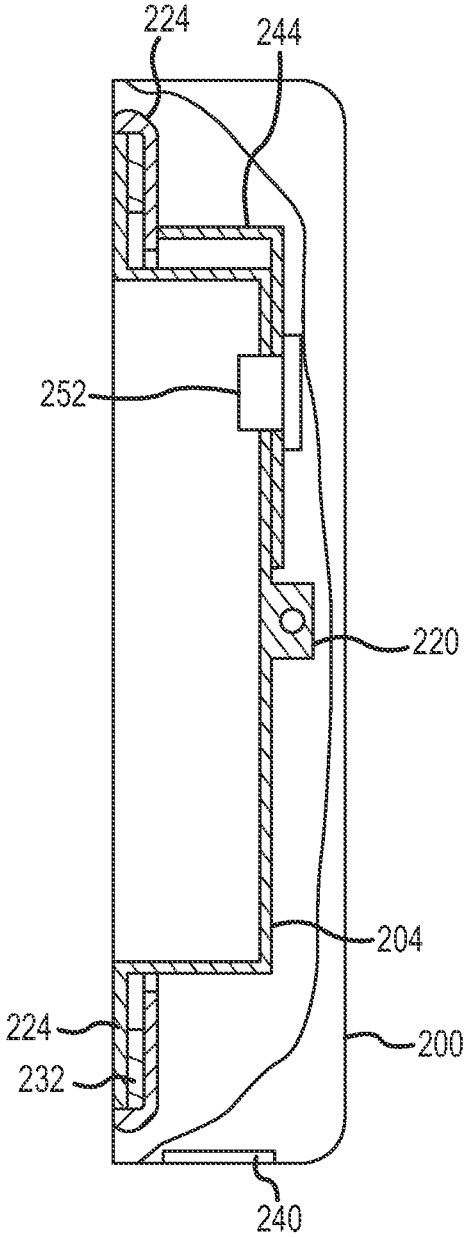
FIG. 14 is a partial side elevation view of FIG. 12 additionally showing the interconnected overflow plate cover.

Referring now to FIGS. 11-14, an adapter 224 of another embodiment that includes a plate 244 that is spaced from a front surface 248 of the adapter 224. The plate 244 engages the overflow plate 204 as shown in FIGS. 12 and 13. The plate 244 is interconnected to the overflow plate 204 with a connector 252 that is fed through a hole 256 in the plate 244 and inserted into one of the holes 216 of the overflow plate 204. One of skill in the art will also appreciate that adhesives may alternatively be applied to join the plate 244 to the overflow plate. The angular orientation of the adapter 224 relative to the overflow plate is irrelevant. That is, the connector 252 and associated plate 244 may be associated with any of the holes 216 provided by the overflow plate 204. Referring specifically to FIG. 14, one of skill in the art will appreciate that the connector 252 and the plate 244 may be integral.

Figure 15:
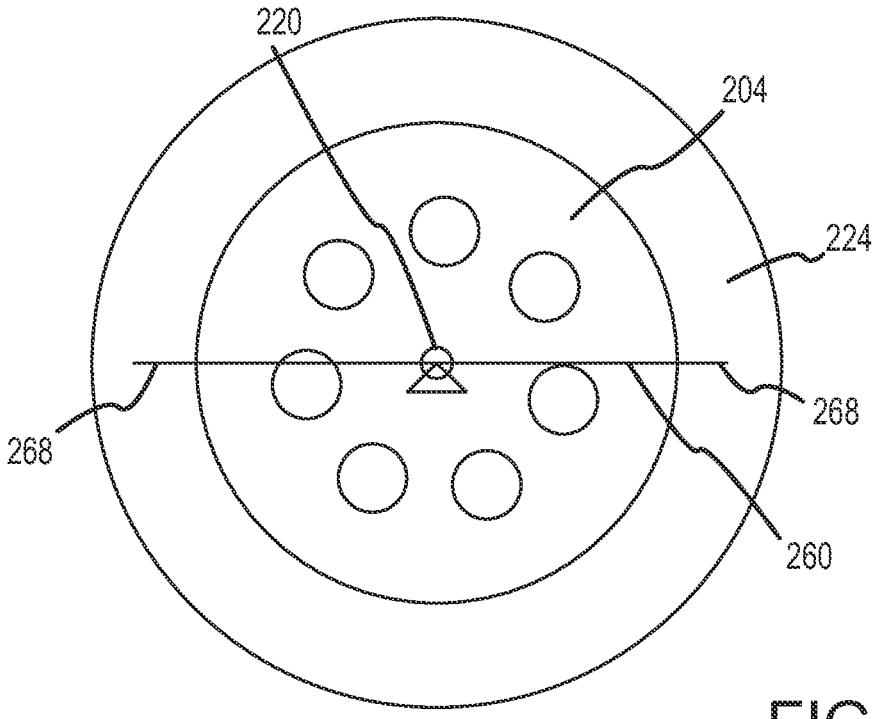
FIG. 15 is a front elevation view of another embodiment of the present invention that employs a retaining member that secures the adapter onto the overflow plate.
Figure 16:
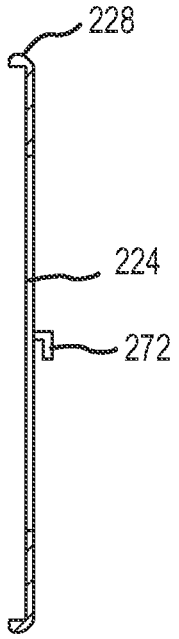
FIG. 16 is an adapter similar to that shown in FIG. 15 that further includes fingers for holding the retaining member.

FIGS. 15 and 16 show another embodiment of the adapter 224 that is associated with the overflow plate 204 with a retaining member 260. The retaining member 206 is threaded through a hole 264 provided by the anchor 220. The outer ends 268 of the retaining member 260 contact the adapter 224 to secure the adapter to the overflow plate. As shown in FIG. 16, to further ensure that the retaining member 260 maintains its engagement with the adapter 224, fingers 272 are employed that hold the ends 268 of the retaining member 260. In addition, to accommodate the end of the stopper chain, the retaining member 260 may include a hole.

Figure 17:
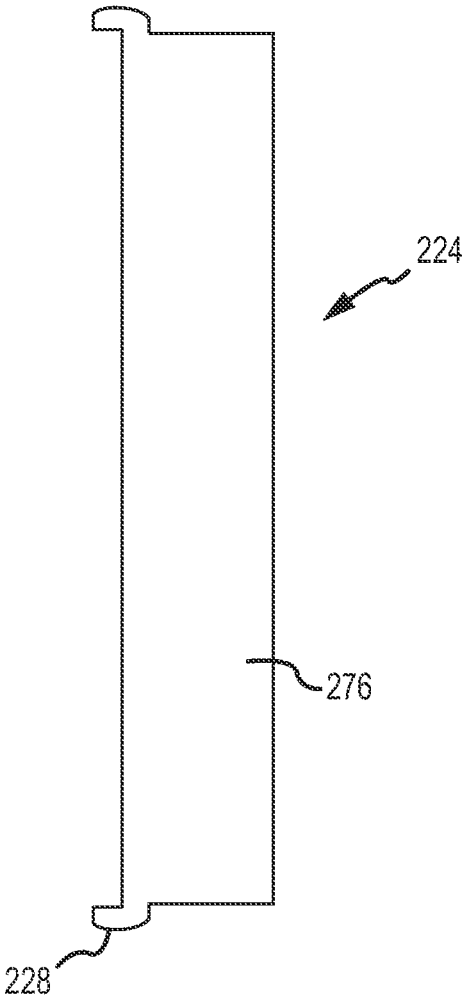
FIG. 17 is a side elevation view of an adapter that may be used with a retaining member similar to that shown in FIG. 15.
Figure 18:
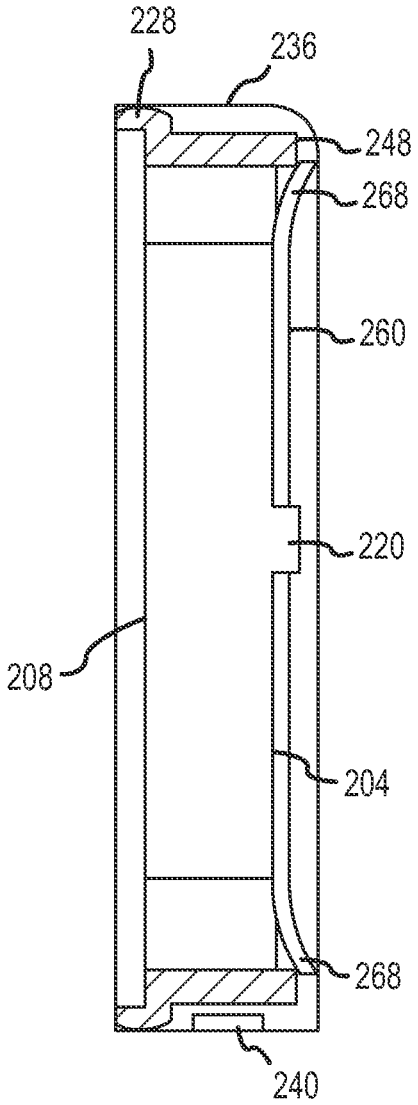
FIG. 18 is a side elevation view showing the adapter of FIG. 17 associated with an overflow plate and an overflow plate cover.

Referring now to FIGS. 17 and 18, an adapter 224 similar to that of FIGS. 15 and 16 is provided. Here, the adapter 224 includes an extended sidewall 276. The distance between the overflow plate 204 and the flange 208 will dictate the width of the adapter sidewall 276. It is contemplated that the extended sidewall 276 may be comprised of a plurality of selectively interconnected pieces such that the sidewall 276 depth may be selectively altered to accommodate overflow systems of various manufacture.

In operation, the adapter 224 is abutted against the flange 208 wherein the front surface 248 of the adapter 224 is coincident or spaced somewhat from the overflow plate 204. The retaining member 260 is then interconnected to the anchor 220 wherein the ends 268 of the retaining member 260 contact the front surface 248 of the adapter 224. As shown, the ends 268 of the resilient retaining member 260 are deflected outwardly, the recoil thereof acts as a spring that helps securely associate the adapter to the overflow plate 204. Again, the adapter 224 includes an outer edge 228 that is associated with a portion of the overflow plate cover 200.

Figure 19:
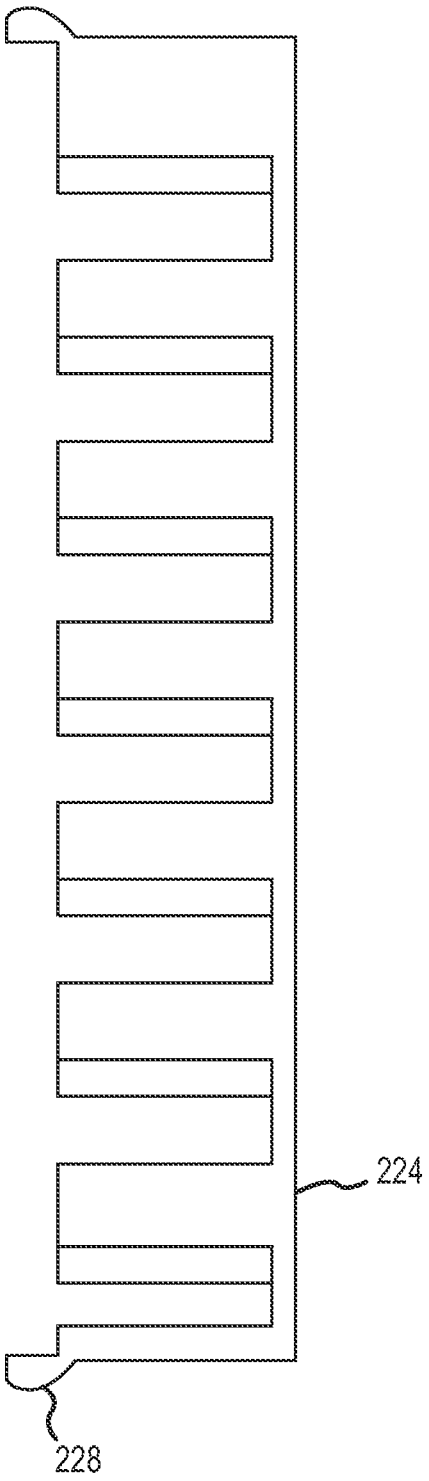
FIG. 19 is a side elevation view of an adapter similar to that of FIG. 17 wherein portions have been removed to provide gaps.

FIG. 19 shows an adapter similar to that of FIG. 17 where portions of the sidewall have been removed.

Figure 20:
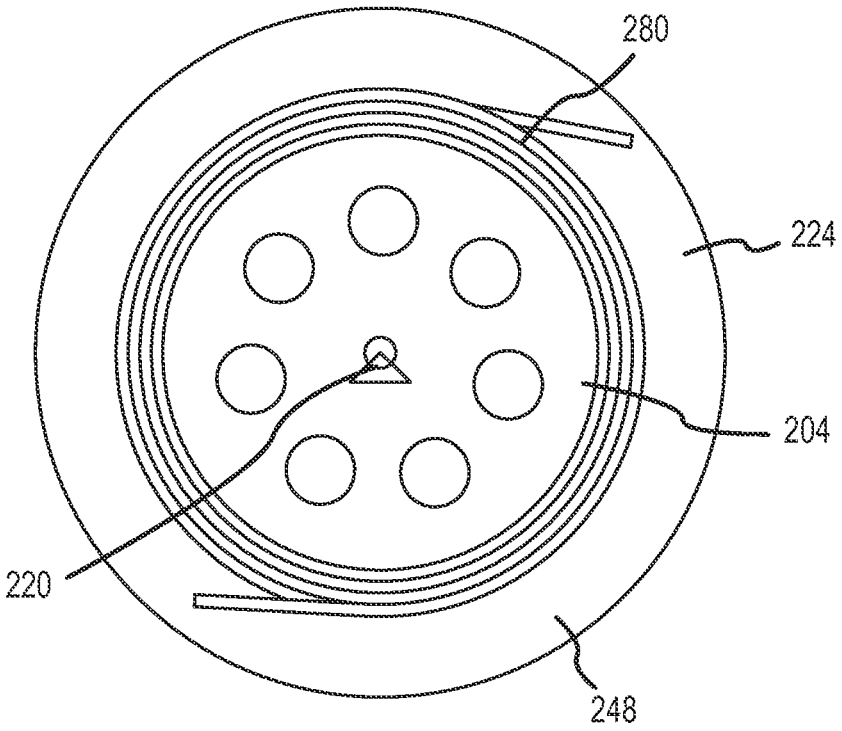
FIG. 20 is a front elevation view of an adapter associated with an overflow plate with a spring member.

Referring now to FIG. 20 another method of associating the adapter 224 with the overflow plate 204 is shown. Here, a spring 280, or other resilient member, is wrapped around the sidewall of the overflow assembly which maintains the relationship between the adapter 224 and the overflow plate 204.

Figure 21:
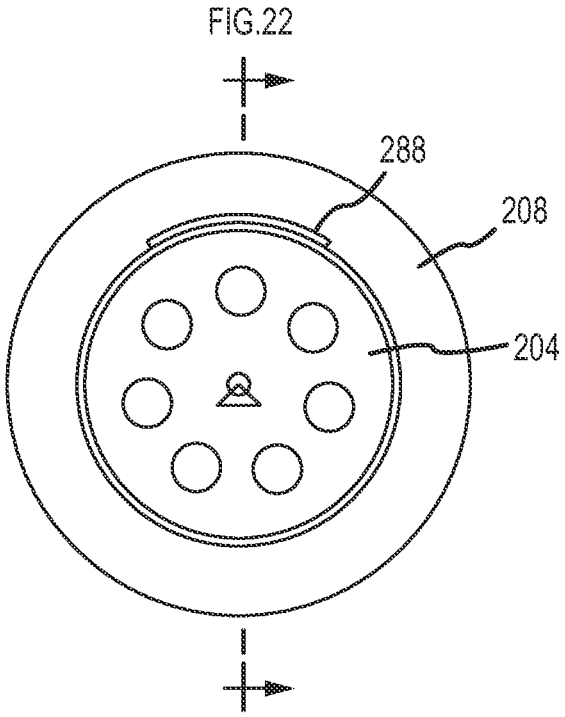
FIG. 21 is a front elevation view of an overflow plate with an adhesive strip incorporated on a sidewall thereof.
Figure 22:
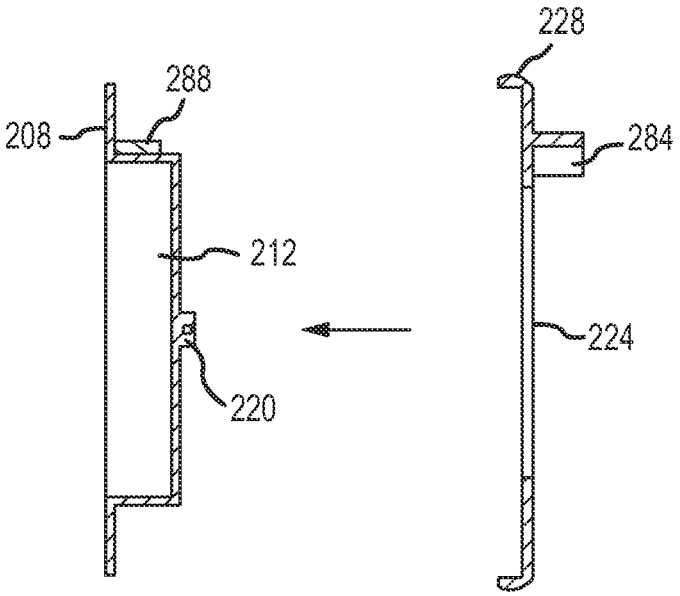
FIG. 22 shows the overflow plate of FIG. 21 with a corresponding adapter spaced therefrom.
Figure 23:
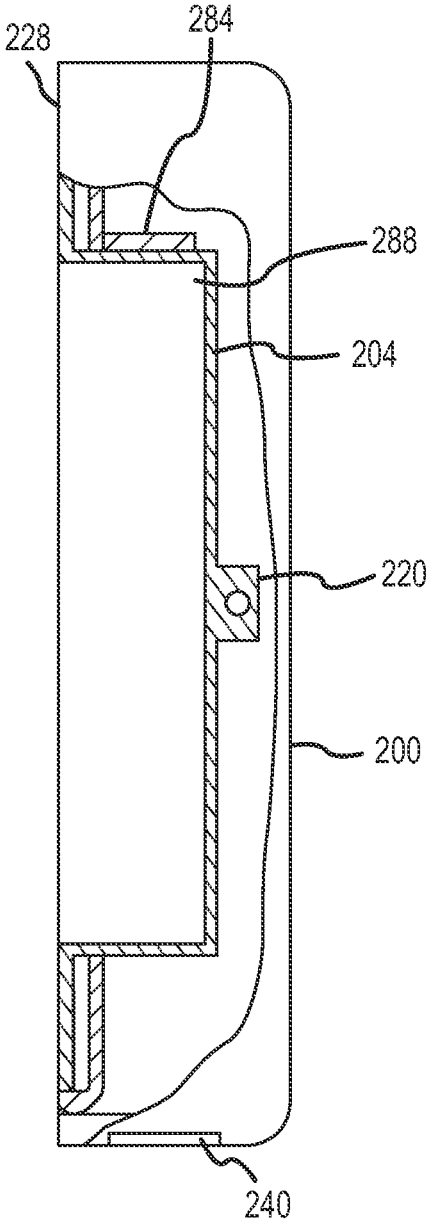
FIG. 23 is a side elevation view similar to that of FIG. 22 additionally showing the overflow plate associated with the adapter.

FIGS. 21-23 show yet another method of interconnecting the adapter 224 to an overflow assembly. Here, the adapter 224 includes a ledge 284 that is interconnected to the sidewall 212 of the overflow port via adhesive 288.

The embodiments of the present invention disclosed herein may be incorporated with the inventions described in U.S. Pat. No. 5,745,931, entitled "Method and Means for Covering the Flange of a Waste Water Strainer", U.S. Pat. No. 5,758,368, entitled "Waste Water Valves For Bathtubs and the Like", U.S. Pat. No. 6,066,119, entitled "Waste Water Strainer and Valve, U.S. Pat. No. 6,148,454, entitled "A Solenoid Control for a Bathtub Waste Water Drain, U.S. Pat. No. 6,173,459, entitled "A Control For a Bathtub Waste Water Drain, U.S. Pat. No. 6,226,806, entitled "Waste Water Strainer and the Like, U.S. Pat. No. 6,317,906, entitled "Strainer Assembly for Bathtub Drains and the Like, U.S. Pat. No. 6,418,570, entitled "Drain Closure, U.S. Pat. No. 6,546,573, entitled "Drain Cover Assembly, U.S. Pat. No. 6,631,623, entitled "Condensate Drain Attachments and Method of Use Thereof, U.S. Pat. No. 6,637,050, entitled "Overflow Assembly for Bathtubs and the Like, U.S. Pat. No. 6,640,358, entitled "Strainer Assembly for Bathtub Drains and the Like, U.S. Pat. No. 6,675,406, entitled "Overflow Assembly for Bathtubs and the Like, U.S. Pat. No. 6,675,407, entitled "Solenoid Activated Bathtub Drain Closure, U.S. Pat. No. 6,681,420, entitled "Method and Apparatus for Installing a Bathtub Assembly, U.S. Pat. No. 6,691,411, entitled "Method of Installing a Waste Water Drain Assembly for a Bathtub, U.S. Pat. No. 7,127,752, entitled "Overflow Assembly for Bathtubs and The Like, U.S. Pat. No. 7,451,502, entitled "Bath Drain Closure Assembly, U.S. Pat. No. 7,503,083, entitled U.S. Pat. "Means for Covering the Flange of a Waste Water Strainer", 2004-0103474, entitled "Cap for Sealing a Bathtub Overflow Port for Testing Purposes, 2004-0117907, entitled "Method and Apparatus for Assembling and Sealing Bathtub Overflow and Waste Water Ports, 2007-0130689, entitled "Tub Box and Method of Using Same, 2008-0047060, entitled "Control for a Bathtub Waste Water Drain, 2007-0039098, entitled "Bath Drain Closure Assembly, 2008-0196161, entitled U.S. CIP Pat." Flexible Bathtub Waste Pipe Assembly for Bathtubs and the Like", 2008-0235866, entitled "U.S. CIP Pat." Overflow Assembly for Bathtubs and the Like"

This application is also related to various patents and patent publications related to drain systems for tubs and other basins. More specifically, U.S. Patent Application Publication Nos. 2007/0039098, filed Aug. 19, 2005 and 2008/0047060, filed Aug. 22, 2006, and U.S. Provisional Patent Application Ser. No. 61/089,692, filed Aug. 18, 2008. Furthermore, U.S. Pat. No. 5,745,931, filed Feb. 9, 1996; U.S. Pat. No. 5,758,368 filed May 21, 1997; U.S. Pat. No. 6,148,454, filed Mar. 4, 1999; U.S. Pat. No. 6,154,898, filed May 19, 1999; U.S. Pat. No. 6,317,906, filed Mar. 10, 1998; U.S. Pat. No. 6,173,459, filed May 26, 1999; U.S. Pat. No. 6,226,806, filed Aug. 2, 2000; U.S. Pat. No. 6,640,358, filed Feb. 6, 2001; U.S. Pat. No. 6,418,570, filed Apr. 4, 2001; U.S. Pat. No. 6,546,573, filed Jul. 17, 2002; U.S. Pat. No. 6,681,420, filed Dec. 3, 2002; U.S. Pat. No. 6,675,407, filed Nov. 8, 2002; U.S. Pat. No. 7,451,502, filed Aug. 23, 2005 and U.S. Pat. No. 7,503,083, filed Aug. 23, 2005, are also related to the inventions described herein. The entire disclosures of each of the prior art references listed above are incorporated by reference herein.

This application is also related to U.S. Patent Application Publication No. 2008/0196161, filed Apr. 10, 2008, which is related to a flexible waste water pipe, the entire disclosure of which is incorporated by reference herein.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. However, it is to be expressly understood that such modifications and alterations are within the scope and spirit of the present invention, as set forth in the following claims.

What is claimed is:

1. A system for concealing a plate of an overflow system, the overflow system comprised of an overflow plate spaced from a flange by way of a sidewall, the flange being engaged on an inner surface of a fluid basin, the overflow plate having a fluid opening that allows fluid to pass from the basin, comprising:

an adapter, which has an outer edge and an inner edge, adapted to be engaged on the flange of the overflow system, wherein the sidewall of the overflow system is positioned within said inner edge of said adapter;

wherein said outer edge of said adapter is comprised of an outwardly extending ring that extends away from a planar portion of said adapter, said outwardly extending ring capable of selectively receiving the overflow plate sidewall;

a first finger and a second finger each protruding from said adapter, said first finger and said second finger adapted to receive and maintain a retaining member that is also associated with the overflow plate cover to secure said adapter to the overflow system; and an overflow plate cover for selective interconnection to said adapter, said overflow plate cover having an outer surface with a wall extending therefrom, wherein said wall selectively engages said outer edge of said adapter, said overflow plate cover also having an opening that provides a continuous fluid flow path from inside the basin to the overflow system.

2. A device that receives a cover for concealing a plate of an overflow system, the overflow system comprised of the overflow plate spaced from a flange by way of a sidewall, the flange being engaged on an inner surface of a fluid basin, the overflow plate having a fluid opening that allows fluid to pass from the basin, comprising:

an outer edge and an inner edge that is adapted to receive the sidewall of the overflow system;

a first and second holding members that protrude from said device, said holding members adapted to receive and maintain a retaining member that secures said device to the overflow system; and wherein said outer edge of said device includes an outwardly extending ring.

3. The device of claim 2, wherein said device selectively receives an overflow plate cover, the overflow plate cover having a sidewall extending therefrom that selectively engages said outer edge of said device.

4. The device of claim 2, wherein said retaining member is positioned in a hole provided by an anchor of the overflow plate.

5. The device of claim 2, wherein said first and said second holding members secure outer ends of said retaining member.

6. The device of claim 2, wherein said retaining member includes a hole that is adapted to accept a drain stopper chain.

7. The device of claim 1, wherein said retaining member is positioned in a hole provided by an anchor of the overflow plate.

8. The device of claim 1, wherein said first finger and said second finger secure outer ends of said retaining member.

9. The device of claim 1, wherein said retaining member includes a hole that is adapted to accept a drain stopper chain.

10. A device that receives a cover for concealing a plate of an overflow system, the overflow system comprised of the overflow plate spaced from a flange by way of a sidewall, the flange being engaged on an inner surface of a fluid basin, the overflow plate having a fluid opening that allows fluid to pass from the basin, comprising:

an outer edge, which comprises an outwardly extending portion that is adapted to receive an overflow plate cover, and an inner edge, which is adapted to accommodate the sidewall of the overflow system when said device is positioned adjacent to, or engaged onto, the flange of the overflow system.

11. The device of claim 10, wherein said device selectively receives an overflow plate cover, the overflow plate cover having a sidewall extending therefrom that selectively engages said outwardly extending portion of said device.

12. The device of claim 10, further comprising a first and second holding members that protrude from said device, said holding members adapted to receive and maintain a retaining member that secures said device to the overflow system.

13. The device of claim 12, wherein said retaining member is positioned in a hole provided by an anchor of the overflow plate.

14. The device of claim 10, further comprising a wall extending from said outwardly extending portion.

15. The device of claim 14, wherein the length of said wall can be selectively reduced.

16. The device of claim 14, wherein the wall includes a plurality of openings.

17. The device of claim 14, wherein said wall extends beyond said overflow plate when said device is interconnected to the flange of the overflow system.

18. The device of claim 17, further comprising a retaining member interconnected to the overflow plate, wherein an outer portion of said retaining member also contacts an outer surface of said wall to secure said device onto the overflow system.

* * * * *